US005715999A

United States Patent [19]

Hsu

[11] Patent Number: 5,715,999

[45] Date of Patent: Feb. 10, 1998

[54] ATOMIZER

[76] Inventor: Chin-tien Hsu, No. 3, Alley 15, Lane 54, Fute 2nd Rd., Hsitzu Chen, Taipei Hsien, Taiwan

[21] Appl. No.: 593,925

[22] Filed: Jan. 30, 1996

[51] Int. Cl.[6] ..... B05B 12/14

[52] U.S. Cl. ..... 239/29; 239/214.25; 239/222.11; 239/333; 239/289; 222/333

[58] Field of Search ..... 239/214.25, 215, 239/222.11, 302, 333, 332, 375, 383, 418, 289, 29.3, 29; 261/28, 90; 222/333

[56] References Cited

U.S. PATENT DOCUMENTS

| | | | |
|---|---|---|---|
| 2,079,117 | 5/1937 | Hays | 239/222.11 |
| 2,257,807 | 10/1941 | Morse | 239/63 |
| 3,004,403 | 10/1961 | Laporte | 62/311 |
| 3,610,527 | 10/1971 | Ericson | 239/222.11 |
| 3,997,115 | 12/1976 | Licudine | 239/351 |
| 4,235,377 | 11/1980 | Davis et al. | 239/315 |
| 4,392,614 | 7/1983 | Groth et al. | 239/315 |
| 4,839,104 | 6/1989 | Steiner | 261/28 |
| 5,338,495 | 8/1994 | Steiner et al. | 261/28 |

*Primary Examiner*—Andres Kashnikow
*Assistant Examiner*—Lisa Ann Douglas
*Attorney, Agent, or Firm*—Gunn, Lee & Miller, P.C.

[57] ABSTRACT

An atomizer comprises an atomizing head having a spray nozzle, an assembly part mounted over the atomizing head, a fan mounted in front of the assembly part and driven by a motor inside the assembly part. The fan has a jet head, the jet head being provided at a center of the front of the fan. A delivery tube is connected between the jet head and the spray nozzle, the delivery tube is located by a cramp disposed on the frame of the fan. The fan comprises a frame disposed therearound, by which the delivery tube is guided and further comprises a hole defined beneath the frame, a first conduit and a second conduit. The first conduit is connected between the spray nozzle of the atomizing head and the hole and the second conduit is connected between the hole and the jet head of the fan.

4 Claims, 2 Drawing Sheets

ATOMIZER

BACKGROUND OF THE INVENTION

1. Field of The Invention

The present invention is related to an atomizer, more particularly to an atomizer having a fan and a delivery tube to meet the needs of efficient atomizing and diffusion.

2. Description of Related Art

Atomizers have been put into various uses, such as in sports, where atomizers are used to cool and refresh players during intervals of rest. A kind of conventional atomizer has a structure where a nozzle is disposed over a container and a pressure trigger is provided in a front of the nozzle to pressure-feed a fluid, e.g. water to be atomized from the container. This kind of conventional atomizer generally is used in certain fields such as delivery of a cleaning agent due to its limited distance of atomizing. When used in sports or other outdoor occasions with wind, this kind of atomizer lacks good efficiency. Another kind of conventional atomizer has been improved to add a fan in front of the nozzle so that the efficiency of diffusion can be increased by means of wind power provided by the fan. This kind of atomizer has a disadvantages that some of the fluid is sprayed on to a back of the fan and some is sprayed randomly due to the improper position of the fan's disposition.

The present invention therefore is aimed to provide an improved atomizer to mitigate and/or obviate the aforementioned problems.

SUMMARY OF THE INVENTION

One object of the present invention is to provide an atomizer having a fan and a delivery tube to realize excellent atomizing and diffusion effects.

In accordance with one aspect of the present invention, the atomizer comprises an atomizing head having a spray nozzle mounted on a container. A housing is mounted over the atomizing head. A fan is mounted to a front of the housing and driven by a motor inside the housing. A jet head is installed on substantially a central front portion of the fan. A delivery tube is connected between the jet head and the spray nozzle.

In accordance with another aspect of the present invention, the fan comprises a frame disposed therearound, by which the delivery tube is guided.

In accordance with a further aspect of the present invention, the jet head is provided at a center of the front of the fan.

In accordance with still a further aspect of the present invention, the fan further comprises a port or hole defined beneath the frame, a first conduit and a second conduit, said first conduit connected between the spray nozzle of the atomizing head and the hole and said second conduit connected between the hole and the jet head of the fan.

Other objects, advantages, and novel features of the invention will become more apparent from the following detailed description when taken in conjunction with the accompanying drawings.

DETAILED DESCRIPTION OF PREFERRED EMBODIMENT

Figure 1:
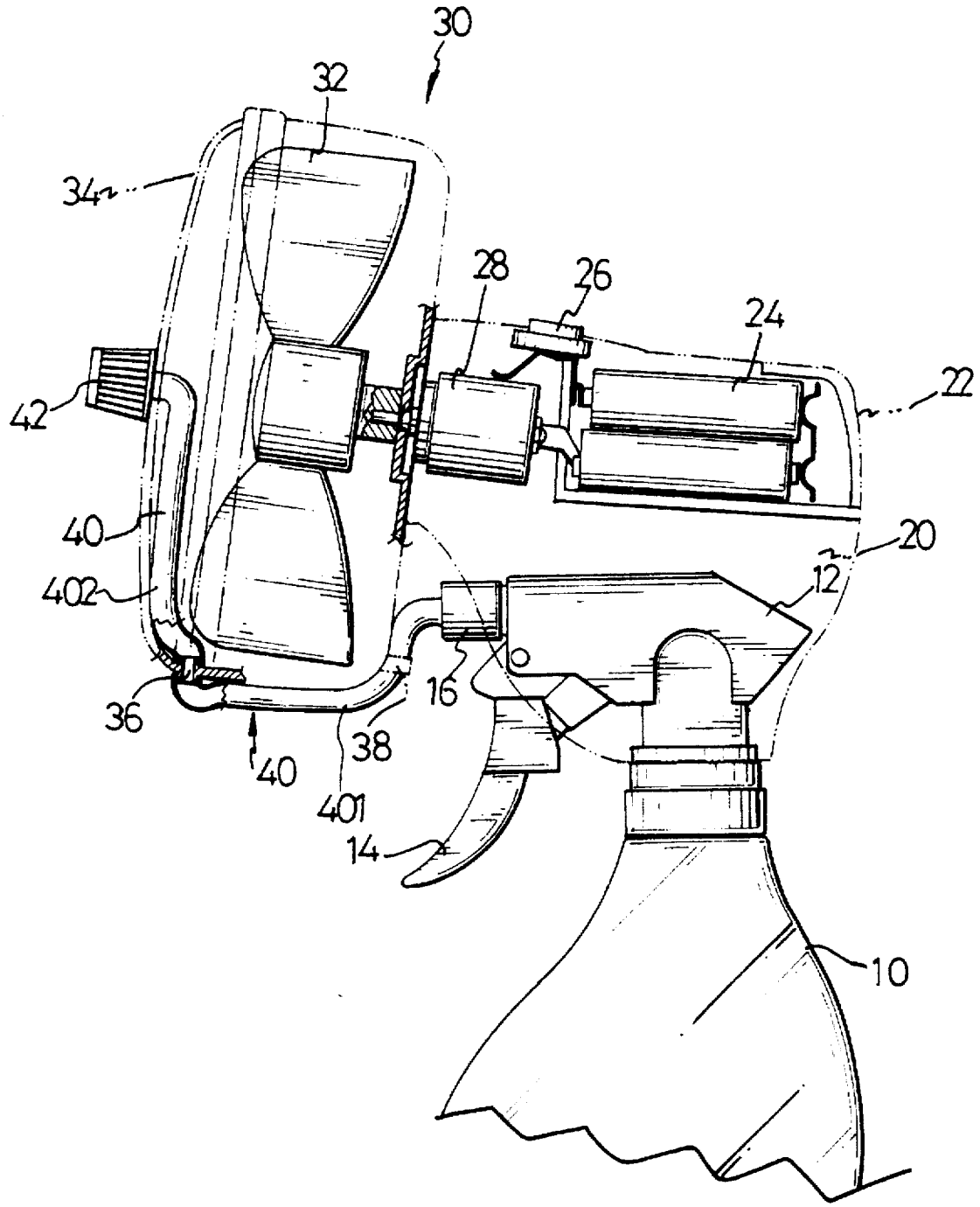
FIG. 1 is a side view showing the structure of the preferred embodiment in accordance with the present invention.

Referring to FIG. 1, there is a side view showing the structure of the preferred embodiment in accordance with the present invention. The atomizer of this invention comprises an atomizing head 12 mounted on a container 10 (the atomizing head 12 may be of a known structure, which comprises a pressure trigger 14 and a spray nozzle 16). A housing 20 is mounted over the atomizing head 12, said housing 20 encloses a battery cover 22, a battery set 24, a switch 26 connected with the battery set 24 and a motor 28 thereinside. A fan 30 is mounted to a front of the housing 20 and is driven by the motor 28. A jet head 42 is installed on substantially a central front portion of the fan 30.

As shown in FIG. 1, the improvement of this invention is that a delivery tube 40 is connected between the jet head 42 and the spray nozzle 16, to provide communication or transfer of a fluid, e.g. water, between and from the container 10 to the jet head 42, wherein said jet head 42 is fixedly provided at a center of a front of the fan. For the purpose of safety, the fan 30 further comprises a frame 34 (shown in phantom lines) disposed therearound, whereby the delivery tube 40 can be guided by the frame 34. By this arrangement, wind power provided by the fan 30 will enable the water from the jet head 42 to be atomized and diffused, furthermore, the water being atomized from the jet head 42 is adjustable to provide different intensities of spray.

Still referring to FIG. 1, it can be seen that the fan 30 further comprises a port or hole 36 disposed beneath the frame 34, a first conduit 401 and a second conduit 402, the first conduit 401 connected between the spray nozzle 16 of the atomizing head 12 and the hole 36 and the second conduit 402 connected between the hole 36 and the jet head 42 of the fan 30. Additionally, the delivery tube 40 is retained in position by a cramp 38 disposed on the frame 34 of the fan 30.

Figure 2:
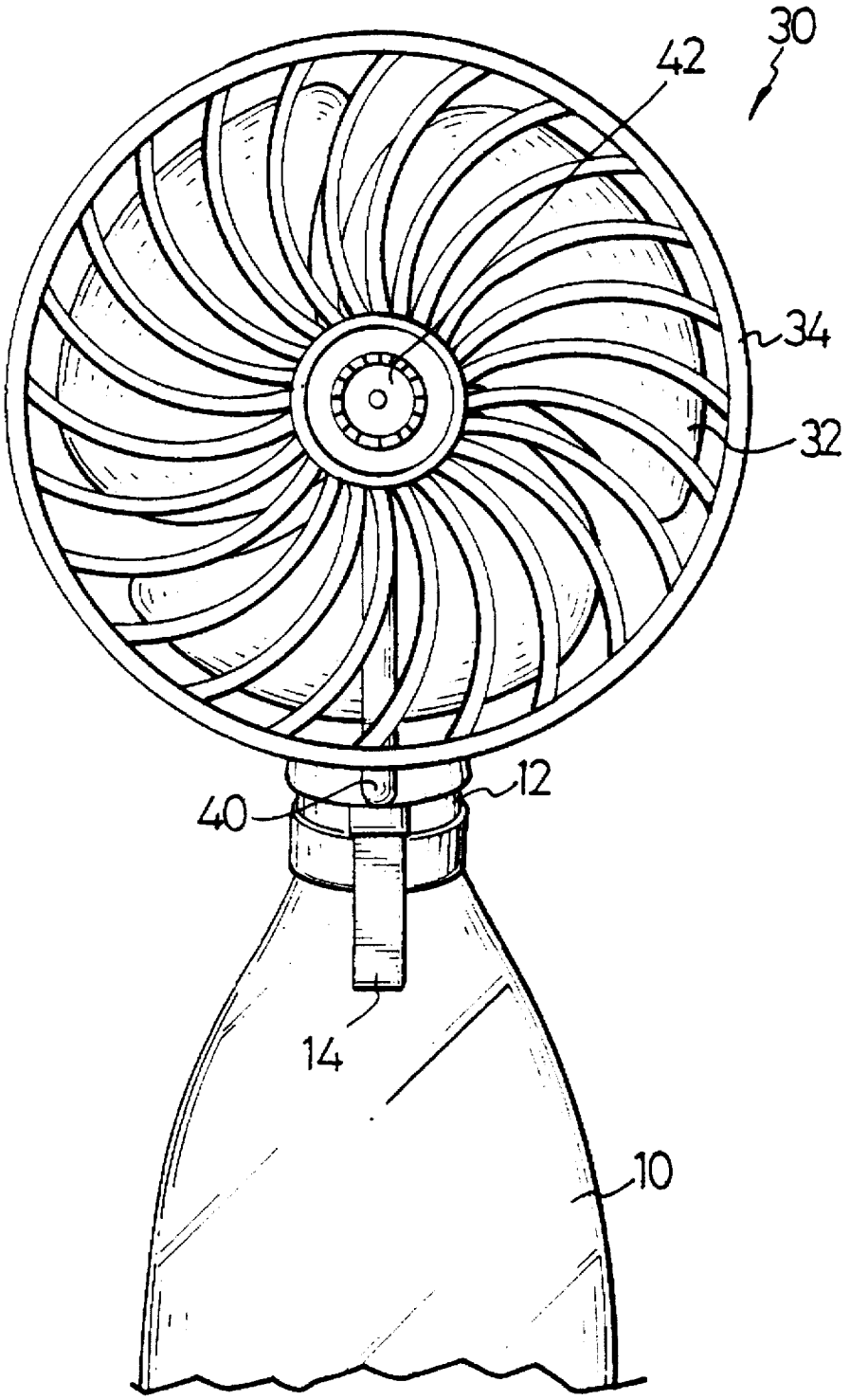
FIG. 2 is a front elevation showing the preferred embodiment in accordance with the present invention.

Referring to FIG. 2, there is a front elevation showing the preferred embodiment in accordance with the present invention. It can be seen that, in operation, the wind power provided by the fan 30 enables the water coming from the delivery tube 40 to be atomized and diffused efficiently and completely due to the central disposition of the jet head 42.

It is to be understood, however, that even though numerous characteristics and advantages of the present invention have been set forth in the foregoing description, together with details of the structure and function of the invention, the disclosure is illustrative only, and changes may be made in detail, especially in matters of shape, size, and arrangement of parts within the principles of the invention to the full extent indicated by the broad general meaning of the terms in which the appended claims are expressed.

What the invention claimed is:

1. An atomizer comprising:

an atomizing means having an atomizing head with a spray nozzle mounted on a container;

a housing mounted over said atomizing means;

a fan mounted on said housing;

a frame disposed around said fan;

a jet head fixed on said frame substantially at a center of a front of said fan;

a port defined substantially at a lower portion of said frame;

a delivery tube comprising a first conduit and a second conduit, said first conduit connected between said spray nozzle of said atomizing head and said port, the second conduit connected between said port and said jet head of said fan, said first conduit and said second conduit in fluid communication and guided by said frame.

2. An atomizer as claimed in claim 1, wherein said housing encloses a motor, a battery cover and a battery set with a switch disposed in a top of said housing and connected between said battery set and said motor.

3. An atomizer as claimed in claim 1, wherein said fan is driven by said motor.

4. An atomizer as claimed in claim 1, wherein said delivery tube is positioned by a cramp disposed on said frame.

* * * * *